US011219263B2

(12) United States Patent
Morgan et al.

(10) Patent No.: US 11,219,263 B2
(45) Date of Patent: Jan. 11, 2022

(54) HELMET WITH NON-NEWTONIAN FLUID LINER SYSTEM

(71) Applicant: Tate Technology, LLC, Pacific Palisades, CA (US)

(72) Inventors: Jenny T. Morgan, Pacific Palisades, CA (US); Gerard E. Morgan, III, Sandy, UT (US)

(73) Assignee: TATE TECHNOLOGY, LLC, Pacific Palisades, CA (US)

( * ) Notice: Subject to any disclaimer, the term of this patent is extended or adjusted under 35 U.S.C. 154(b) by 91 days.

(21) Appl. No.: 16/738,985

(22) Filed: Jan. 9, 2020

(65) Prior Publication Data

US 2020/0221807 A1 Jul. 16, 2020

Related U.S. Application Data

(60) Provisional application No. 62/790,618, filed on Jan. 10, 2019.

(51) Int. Cl.
*A42B 3/12* (2006.01)
*A42B 3/06* (2006.01)

(52) U.S. Cl.
CPC ..... *A42B 3/063* (2013.01); *A42B 3/121* (2013.01)

(58) Field of Classification Search
CPC ..... A42B 3/063; A42B 3/121
See application file for complete search history.

(56) References Cited

U.S. PATENT DOCUMENTS

| | | | | |
|---|---|---|---|---|
| 9,314,060 | B2 | 4/2016 | Giles | |
| 9,839,251 | B2 * | 12/2017 | Pannikottu | A42B 3/125 |
| 2006/0234572 | A1 | 10/2006 | Wagner et al. | |
| 2008/0172779 | A1 * | 7/2008 | Ferguson | A41D 31/285 2/455 |
| 2014/0068841 | A1 * | 3/2014 | Brown | A42B 3/122 2/413 |
| 2015/0272258 | A1 * | 10/2015 | Preisler | A63B 71/10 2/412 |
| 2016/0000167 | A1 * | 1/2016 | Alley | A42B 3/20 2/412 |
| 2016/0255900 | A1 * | 9/2016 | Browd | A42B 3/121 |
| 2017/0232327 | A1 * | 8/2017 | Kuntz | A42B 3/125 2/413 |
| 2019/0029352 | A1 * | 1/2019 | Sadegh | A42B 3/06 |
| 2019/0350295 | A1 * | 11/2019 | Timlick | A42B 3/064 |

* cited by examiner

*Primary Examiner* — Tajash D Patel
(74) *Attorney, Agent, or Firm* — Jeffer Mangels Butler & Mitchell LLP; Brennan C. Swain, Esq.

(57) ABSTRACT

A helmet assembly that includes an outer shell having an outer surface and an inner surface and defines a shell interior, a pad system disposed in the shell interior, and at least a first bladder member positioned between the inner surface of the outer shell and the pad system. The first bladder member defines a bladder interior and a non-Newtonian fluid is disposed in the bladder interior.

8 Claims, 9 Drawing Sheets

HELMET WITH NON-NEWTONIAN FLUID LINER SYSTEM

CROSS REFERENCE TO RELATED APPLICATIONS

This application claims the benefit of U.S. Provisional Application No. 62/790,618, filed Jan. 10, 2019, the entirety of which is incorporated herein by reference.

FIELD OF THE INVENTION

The present invention generally relates to protective helmet and gear, such as helmets, liner systems and liner padding systems in helmets, padding, body armor, etc.

BACKGROUND OF THE INVENTION

Various activities, such as contact and non-contact sports, included, but not limited to the sports of football, baseball, hockey, motorcycling, cycling, skiing, snowboarding, motocross, BMX, and more requiring the use of helmets that incur impacts and related concussive forces resulting from impacts with other players, helmet wearers, the ground, balls, bats, pucks, walls, including impacts with elbows, knees, heads and so forth, and recent attempts to protect participants from impact injuries to their heads and necks etc. due to the repetitive and from sub-concussive hits to severe impacts forces that may be sustained during such activities.

Protective helmets and liner systems are used and have primarily one element for function, or one function, which is for protecting the wearer from contact with other players/helmet wearers, balls, the ground, etc. Manufacturers' helmets typically cover the majority of or the entire head.

SUMMARY OF THE PREFERRED EMBODIMENTS

In accordance with a first aspect of the present invention there is provided a helmet assembly that includes an outer shell having an outer surface and an inner surface and defines a shell interior, a pad system disposed in the shell interior, and at least a first bladder member positioned between the inner surface of the outer shell and the pad system. The first bladder member defines a bladder interior and a non-Newtonian fluid is disposed in the bladder interior. In a preferred embodiment, the bladder member includes a plurality of cells defined therein, and each cell includes the non-Newtonian fluid disposed therein. Preferably, each cell has a honeycomb shape. In a preferred embodiment, each cell defines a cell axis, and the cell axes are oriented generally perpendicular to the outer surface of the helmet. Preferably, the bladder comprises a polymer. In an embodiment, the helmet assembly includes a plurality of coil members that are disposed in the bladder interior and within the non-Newtonian fluid.

In accordance with a first aspect of the present invention there is provided a helmet assembly that includes an outer shell that includes an outer surface and an inner surface and defines a shell interior, and a pad system disposed in the shell interior. The pad system includes at least a first pad assembly that includes a pad portion and a fluid portion. The fluid portion is positioned between the pad portion and the outer shell, and the fluid portion defines a pocket that includes a non-Newtonian fluid disposed therein. In a preferred embodiment, the pocket of the pad portion includes a plurality of cells defined therein, and each cell includes the non-Newtonian fluid disposed therein. Preferably, each cell has a honeycomb shape. In a preferred embodiment, each cell defines a cell axis, and the cell axes are oriented generally perpendicular to the inner surface of the inner surface of the helmet. In a preferred embodiment, the pocket comprises a bladder member that comprises a polymer. In another embodiment, the non-Newtonian fluid can be disposed in a cut-out or pocket in the pad. In an embodiment, a plurality of coil members that are disposed in the pocket and within the non-Newtonian fluid.

The current invention is an advanced sports safety non-Newtonian football and other sport helmet liner technology system and apparatus that is designed to protect the head from injury resulting from sports and other impacts. The current invention is designed to dissipate and energy attenuate impact energy force in which linear and rotational acceleration result from the impact force in the liner system. The current invention, as a protective sports safety liner system, includes a force attenuating layer in a non-Newtonian fluid contained within the helmet liner system having an outer surface, an inner surface, a front region, a rear region, a crown region, and two side regions, which may be linked cells/pockets/honeycomb or one contiguous system either in the liner system or incorporated into or with the helmet shell structure. In an embodiment, the helmet assembly can include a coil system or a plurality of coil members that are disposed in the bladder interior and within the non-Newtonian fluid or separate from the non-Newtonian fluid, but in addition to the non-Newtonian fluid.

The current invention further comprises an improved reinforcement force attenuating impact through the use of a non-Newtonian fluid for use in a variety of sports safety helmets and other sports safety equipment. In one embodiment, the present invention encompasses a force attenuating reinforcement apparatus as stated herein that is articulated so that the displacement of impacts results in a force component beyond the impact axis of the impact of the current liner systems used in sports safety helmets today, or the prior art. The impact force attenuating non-Newtonian fluid(s) can be incorporated into a wide variety of advanced sports safety helmets or helmets of a variety of sizes and configurations to produce impact reduction and/or other advantages.

The current invention further comprises an improved head protection system for use of dilitants, shear thickening fluids (STF) or non-Newtonian fluid(s) used in head and other protection devices, taking into account the content, consistency, and properties of the fluid(s) and use with impact force. The non-Newtonian fluid(s) transition to act, due to the nature and properties of the non-Newtonian Fluid, as a hard helmet shell at the point of impact, otherwise the fluid(s) remain naturally in a suspended or fluid state. Non-Newtonian fluids do not undergo strain rates proportional to the applied shear stress. The rheology of a colloidal PEG-based shear thickening fluid emulsified with silicone oil is one potential option, as taught in US Patent Publication number 2006/0234572, the entirety of which is incorporated herein by reference, where a shear thickening response is observed in the viscosity-shear rate curves for volume fractions as low as 10% of the STF in the silicone emulsion, which might be one fluid solution.

Dilatancy in a colloid, or its ability to order in the presence of shear forces is dependent on the ratio of interparticle forces. As long as interparticle forces, such as Van der Waals forces dominate, which is the sum of the attractive or repulsive forces between molecules, the suspended particles remain in ordered layers. However, once shear forces dominate, particles enter a state of flocculation and are no longer held in suspension; they begin to behave like a solid. When the shear forces are removed, the particles spread apart and once again form a stable suspension In the current invention the fluid flows and their directions, combined with the energy flows coincide due to the nature of fluid flows not being generic in the design of the current invention, in other words not being a straight parallel flow from point A to B, such as in a tube or box with boundaries, but with boundary conditions leading to radial flows. When using the Navier-Stokes equations, the modeling must address multiple distributions, ranging from as simple as the distribution of static pressure to as complicated as multiphase flow driven by surface tension, or in the case of the impact force of the current invention, which could include both parallel linear and radial flows.

Difficulties may arise when the problem becomes slightly more complicated. A seemingly modest twist on the parallel flow above would be the radial flow between parallel plates; this involves convection and thus non-linearity.

The current invention further comprises the energy flows just past compression into the liner system immediately behind the point of incident or impact or immediately behind the helmet shell or inside of the helmet shell. The contact mechanics is contact between two helmets with the flows spreading into the non-Newtonian fluid which solidifies upon impact. The energy flows naturally radiate into the liner system. The shear thickening fluid forms at the point of impact to linearly and non-linearly at least in the tangential or shear direction to mitigate angular acceleration of the head during an impact.

The current invention further comprises an improved mechanism to protect helmet wearers using the non-Newtonian fluid(s) in a liner system in a helmet. The non-Newtonian fluid may be contained with an additional cell, cells or honeycomb incorporated into current padded liner systems, or added to EPS liners using a current plastic outer layer material, as used by current helmet manufacturers with an added cell, cells or honeycomb that resides closest to the helmet shell or furthest from the wearers head or may be added to the inside of the helmet shell with an added cell, cells or honeycomb that resides immediately inside and affixed to the helmet shell. The layer containing the non-Newtonian fluid can be a closed/sealed tube made of polyurethanes, polyolefins or any polymeric material to contain and maintain the shear thickening fluid locked within the inner layer in a permanently enclosed environment.

The non-Newtonian shear thickening fluid of the present invention has a viscosity of a shear thickening fluid or dilatant fluid that appears to increase when the shear rate or impact force increases. Corn starch dissolved in water ("oobleck") is a common example: when stirred slowly it looks milky, when stirred vigorously it feels like a very viscous liquid. The shear thickening fluid of the present invention using corn starch and non-toxic anti-freeze could also alternatively be a surfactant solution, such as Dawn dish soap, which has been shown to clearly exhibit a shear thickening transition or any fluid which exhibits an increase in viscosity with increasing applied shear stress or shear rate. In a non-Newtonian fluid, the relation between the shear stress and the shear rate is different and can even be time-dependent (Time Dependent Viscosity). Therefore, a constant coefficient of viscosity cannot be defined.

Since the application of the current invention uses plastics that are tough and impact resistant encapsulating materials with which to hold the shear thickening non-Newtonian fluid. The current invention considers weight of the shear thickening fluid using corn starch, water, and/or non-toxic anti-freeze, as well as the composition where the viscosity increases with shear rate, and at high shear rates instantly transforms into a material with solid-like properties and reverses itself just as quickly once the incident of impact force or shear rate is substantially reduced by energy attenuation through the coil system, as well as naturally inherent in the dilitant fluid selected. In a preferred embodiment, the present invention includes a non-Newtonian fluid that comprises corn starch and non-toxic antifreeze encased in a plastic sleeve, which is surrounded by lightweight foam and outer fabric (e.g., a wicking material). Any non-toxic antifreeze is within the scope of the present invention. For example, propylene glycol is considerably less toxic than ethylene glycol and may be labeled as "non-toxic antifreeze." It is used as antifreeze where ethylene glycol may be inappropriate, such as in food-processing systems or in water pipes in homes where incidental ingestion may be possible. For example, the U.S. FDA allows propylene glycol to be added to a large number of processed foods, including ice cream, frozen custard, salad dressings, and baked goods, and it is commonly used as the main ingredient in the "e-liquid" used in electronic cigarettes. Propylene glycol oxidizes to lactic acid. U.S. Pat. No. 9,314,060 (the "'060 patent") is incorporated by reference herein in its entirety.

In a preferred embodiment, the current invention holds a static mass inside as well as outside, or the two masses, the helmet and the fluid remains constant. The conservation of mass is in relationship to the hard shell counterparts, and the density of the fluid will remain constant. The current invention also addresses the viscosity of the fluid, which is a constant of proportionality between the viscous stress tensor and the velocity gradient, or the viscosity. Non-Newtonian fluids do not undergo strain rates proportional to the applied shear stress, and non-Newtonian fluids viscoelastic, which the current invention addresses. Viscoelasticity is the property of materials that exhibit both viscous and elastic characteristics when undergoing deformation. Viscous materials, like honey, resist shear flow and strain linearly with time when a stress is applied. Elastic materials strain when stretched and quickly return to their original state once the stress is removed. Viscoelastic materials have elements of both of these properties and, as such, exhibit time-dependent strain. Whereas elasticity is usually the result of bond stretching along crystallographic planes in an ordered solid, viscosity is the result of the diffusion of atoms or molecules inside an amorphous material.

Within the scope of this invention, the shear thickening fluid may contain concentrated dispersions of microscopic particulates within a fluid medium that exhibit an increase in viscosity with increasing applied stress. Particles may be of any solid material, including spherical amorphous silica such as that produced via Stober type synthesis, synthetic inorganic particles synthesized via solution precipitation processes such as precipitated calcium carbonate, or synthesized by gel-sol techniques (hematite, $TiO_2$), or fumed silica, or carbon black. Natural inorganic particulates, such as montorillonite and kaolin clays can be dispersed in solvents and have been shown to exhibit shear thickening behavior. Ground mineral powders, such as quartz, calcite, talcs, gypsum, mica can be dispersed in liquid mediums and exhibit shear thickening behavior. It will be appreciated that the term non-Newtonian fluid is used to refer to all the non-Newtonian fluids, shear thickening fluids and dilitants discussed herein.

One embodiment of the invention relates to various blends of shear thickening fluids incorporated into a second fluid medium exhibit rheological behavior indicating their ability to impart improved energy dissipative capabilities to composites.

The following synopsis represents a summary of aspects of the invention to provide a basic understanding of the invention, and the purpose of the invention. This summary is just that to provide an overview of the invention, and is not intended to identify all key critical elements of the invention, or to define/describe the scope, capacity or opportunity of the invention. The summary simply provides some concepts of the invention in a general form, as an introduction to the comprehensive description outlined below.

Aspects of the invention pertain to helmet or helmet members and liner system(s) of the previous art receiving members/devices, such as a helmet or helmet system(s) (i.e., helmets and helmets already manufactured principally for use for athletics, and any other daily use where protection from impacts is required, such as, but not limited to construction, military, police/riot helmets beyond the universal sports application), which includes a helmet member, a liner system member, which both respectively are complete units, engaged as a helmet protection system where the outer layer may be comprised of one or more materials designed for repeated or one-time impacts, including, but not limited to polycarbonate, ABS, Kevlar, Carbon Fiber, Fiberglass, and composites of these and more material science, and the inner liner system member/layer may be comprised of one or more material science in the form of padding enclosed/encased within a flexible polymer plastic system designed to hold pads, and other systems, such as air, suspension design. The liner system member(s) of the present invention may include an enclosed plastic or flexible polymer system, but with an added cavity, cavities, honeycomb or enclosed void(s), or pocket(s) added to house or contain non-Newtonian fluid(s) of the present invention. The liner system member of the present invention is designed to be right next to/adjacent, or closest to the helmet or helmet shell member system, or residing next to, or nearest to the outer layer member or helmet shell to dissipate and energy attenuate impact force, but be part of, or attached, or incorporated into the liner system member. The liner system member(s) may also include or define a cavity, cavities, honeycomb, or enclosed void(s), or pocket(s)cavities, honeycomb, or enclosed void(s), or pocket(s)receiving device to house or hold the non-Newtonian fluid. The added cavity, cavities, honeycomb, or enclosed void(s), or pocket(s) added to house or contain non-Newtonian fluid(s) of the present invention may also be incorporated next to the inside of the helmet shell.

In accordance with the present invention embodiment, the apparatus comprises head protection in the form of a helmet, and the helmet comprises a multi-layered sidewall, frontwall, and back-wall, and defines an opening for a head of a wearer. The wall(s) of the helmet comprise an outer layer, and an inner layer positioned proximate to the inner liner system layer. The helmet comprises a multi-layered sidewall, front-wall, back-wall, and also comprises a multi-layered crown, crown area, top wall or panel. The multi-layered sidewall extends from multi-layered top wall or panel as one contiguous unit, and defines an opening for a head of a user or wearer. The helmet and the liner system are properly fitted to each wearer's head.

In accordance with another embodiment, the apparatus comprises a liner system where the inner layer of the liner system defines a cavity, cavities, honeycomb, or enclosed void(s), or pocket(s) cavities, honeycomb, or enclosed void(s), or pocket(s)receiving device to house or hold the padding of the prior art, and where the outer layer of the liner system defines a cavity, cavities, honeycomb, or enclosed void(s), or pocket(s) receiving device to house or hold the non-Newtonian fluid residing next to, or nearest to the outer member or helmet shell. The non-Newtonian fluid is continually suspended in liquid form within the specified enclosed pocket(s)/void(s)/cavities liner system member(s) specifically located right next to the inner portion of the helmet outer shell. The outer layer of the liner system also comprises a layer positioned specifically next to the helmet outer layer, with the liner system layer having a full circumference surface, where it is circumferentially spaced in relationship to the helmet outer layer. The inner layer of the liner system has a top edge surface, a bottom edge surface and a circumference sidewall surface to define each correlated cavity, void, or pocket. The added cavity, cavities, honeycomb, or enclosed void(s), or pocket(s) added to house or contain non-Newtonian fluid(s) of the present invention may also be incorporated next to the inside of the helmet shell.

In accordance with yet another embodiment, the liner system apparatus is to be worn by a user coupled with a hard surface helmet shell, and the current invention comprises head protection in the form of additions to prior art liner systems when participating in sports. The liner system layer that may contain a very thin layer of plastic or polymer layer defines a cavity, void or pocket receiving device housing the non-Newtonian Fluid(s). The non-Newtonian fluid is designed to dissipate and energy attenuate an impact force as applied to the head protection.

Additional aspects of the invention relate to sample methods for providing body protection using a non-Newtonian fluid contained within the body protection with designed individual cavities. Such methods may include athletic vests, body armor, body padding, etc., as receiving members.

Aspects of the invention pertain to a liner system layer(s) or member(s), containing non-Newtonian fluid, "coil system" member, receiving devices, which may include a helmet, which includes a helmet member with an outer layer, a liner system layer containing and inner layer of the liner system that contains padding, and an outer layer of the liner system that contains non-Newtonian fluid, which are all engaged with each other as one complete unit, engaged as a head protection system.

Additional aspects of the invention relate to sample methods for providing body protection using an outer layer member, and inner layer member, and non-Newtonian fluid. Such methods may include athletic vests, other protective wear, etc., as receiving members.

A non-Newtonian football and other sport helmet liner system and apparatus that is designed to protect the head from injury including a liner system which includes a layer(s) positioned adjacent or right next to the helmet shell containing non-Newtonian fluid cells or pockets or cavities contained within the liner system having an outer surface, an inner surface, a front region, a rear region, and two side regions, a crown region whether these are individual cells, or as one continuous padded liner system unit.

The liner system device can also include a multi-layered sidewall, frontwall, backwall, the multi-layered wall(s) comprising: a pocket, cell, or void layer with padding. The added pocket layer containing non-Newtonian fluid. The layer positioned closest to the helmet shell to define a pocket and the layer cavity or pocket may contain the non-Newtonian fluid. The layer nearest the helmet shell forms a substantially rectangular or square shape, or a shape to match current individual pad cells contained therein in liner systems, and wherein the layer is substantially flat over the wearers head extending circumferentially about/around the wearers head.

The liner system device can also include a multi-layered sidewall, frontwall and backwall. The multi-layered wall(s) including a pocket, cell, or void layer with current padding, the added pocket layer containing non-Newtonian fluid. The layer positioned closest to the helmet shell to define a pocket and the layer cavity or pocket may contain the non-Newtonian fluid. The layer nearest the helmet shell forms a substantially rectangular or square shape, or a shape to match current individual pad cells contained therein in liner systems, and is substantially flat over the wearers head extending circumferentially about/around the wearers head. The non-Newtonian fluid layer includes a first surface, a second side surface, a third side surface, a fourth side surface, a front surface, and a back surface, and the first side surface and the second side surface and the third side surface and the fourth side surface are connected by the bottom surface, and the these side surfaces are connected to the top or crown surface circumferentially around the head. Preferably, the first, second, third, and fourth surface(s) material extends continuously and circumferentially about the head, and the non-Newtonian fluid is contained continuously and circumferentially. The non-Newtonian fluid can be contained in individual cells or pockets, or one continuous cell or pocket in the liner system from the crown down to the base of the circumferential side walls about or around the users or wearers head.

In a preferred embodiment, the layer nearest to, or adjacent to the helmet shell may contain one or more cells or pockets with non-Newtonian fluid designed to dissipate and energy attenuate impact force immediately next to the point of impact or compression in the helmet member.

In a preferred embodiment, one or more layers may contain a dilitant, shear thickening fluid, or non-Newtonian fluid to act as a dilitants, or Non-Newtonian fluid(s), or shear thickening fluids used in head and other protection devices, taking into account the content, consistency, and properties of the fluid(s) and use with impact force. The non-Newtonian fluid(s) transition to act, due to the nature and properties of the non-Newtonian Fluid, as a hard helmet shell at the point of impact, otherwise the fluid(s) remain naturally in a suspended or fluid state.

Preferably, the dilitants, or Non-Newtonian fluid(s), or shear thickening fluids have a relationship with both the helmet shell, as well as with the padded liner and other liner systems of the prior art where the non-Newtonian fluid absorbs impact force immediately past the point of compression and first in tension to dissipate and energy attenuate where the STF whose viscosity increases with shear rate, including discontinuous STF's where at high shear rates transform into a material with solid-like properties, wherein the energy is dissipated.

In a preferred embodiment, the liner system is flexible to a certain degree based upon the plastic material used to enclose the pads, non-Newtonian fluids, and other liner options between a semi-relaxed relationship and a semi-expanded relationship upon placement on a head of a wearer. Preferably the liner system maintains to a degree an compressive and expansive force to maintain placement and removal from the head of the wearer.

In a preferred embodiment, the crown portion of the liner system is flexible to a certain degree based upon the plastic material used to enclose the pads, non-Newtonian fluids, and other liner options between a semi-relaxed relationship and a semi-expanded relationship upon placement on a head of a wearer. Preferably, the liner system maintains to a degree an compressive and expansive force to maintain placement and removal from the head of the wearer.

In a preferred embodiment, the layer cells, pockets, cavities, or voids containing the non-Newtonian fluid in the liner system are attached via glued, heat sealed, produced in plastic formation of the liner system, or using some other method of attachment.

DETAILED DESCRIPTION OF THE PREFERRED EMBODIMENTS

Figure 1:
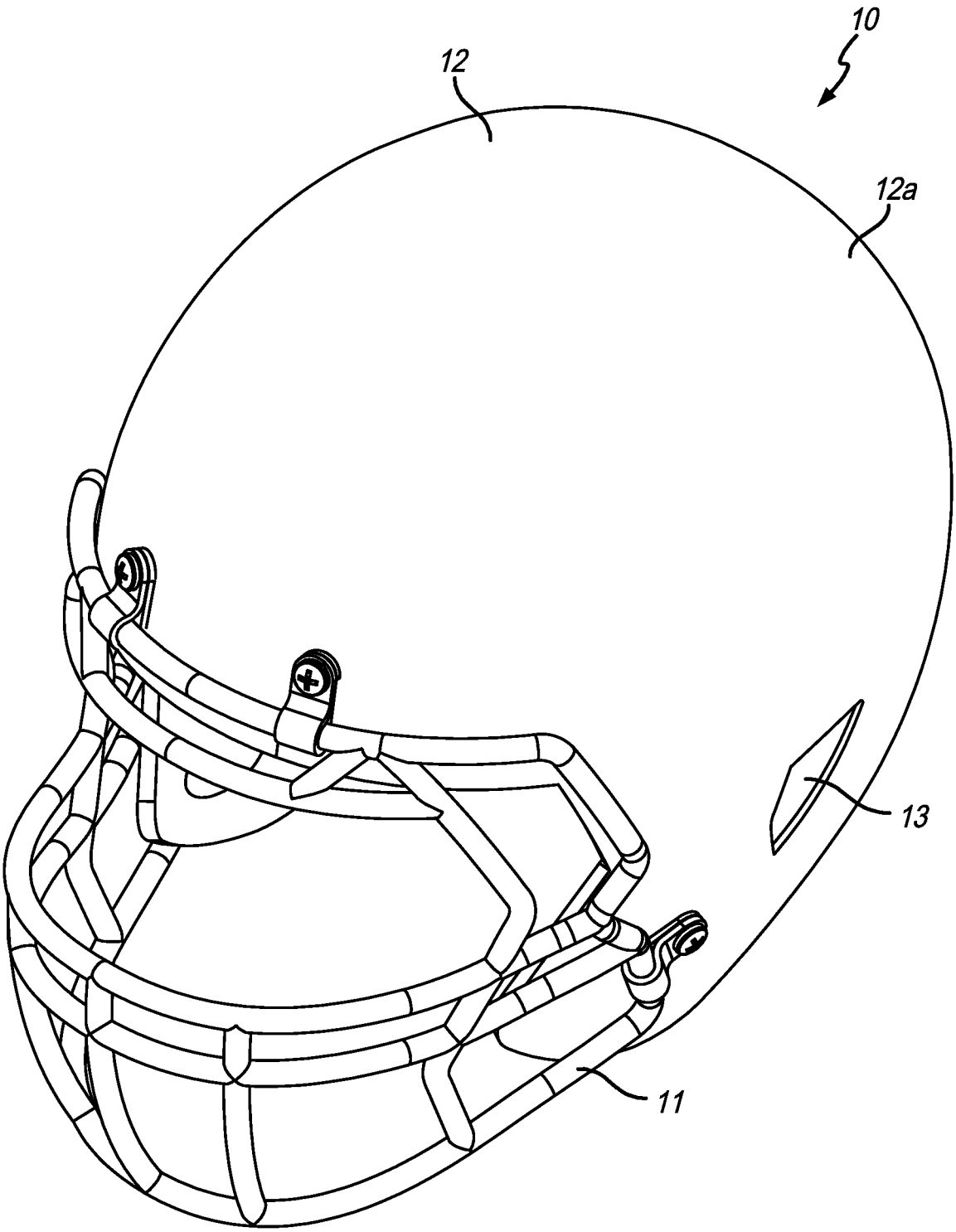
FIG. 1 is a perspective view of a helmet assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

The invention generally relates to safety helmets, such as for activities and sports including, but not limited to football, baseball, hockey, skiing, cycling, and further includes, other sports requiring some form of head protection, but not with a hard or solid helmet shell comprised of materials science such as Polycarbonate, ABS, Carbon Fiber, Fiberglass, and more. The invention also generally relates to protective gear, such as padding, body armor, etc. This invention relates generally to a helmet protection system designed to protect the human head from injury resulting from sports impacts where helmets are typically worn.

The method of the present invention embodies an inherent liner system added to the interior of a hard helmet shell with a liner system layer, or closed/sealed cells containing padding made of polyurethanes, polyolefins or any polymer or polymeric material to contain and maintain the padding, or the added cavity, cavities, honeycomb, or enclosed void(s), or pocket(s) added to house or contain non-Newtonian fluid(s) of the present invention may also be incorporated next to the inside of the helmet shell. Additionally, the method of the present invention contains/adds an additional closed/sealed pocket in the liner system to hold the shear thickening fluid, locked within the layer nearest to the helmet shell in a permanently enclosed environment. The present invention with the non-Newtonian fluid dissipates and energy attenuates impact force from an impact or contact of the helmet or helmet using STF to dissipate and energy attenuate impact force. The non-Newtonian fluid or STF thickening properties at impact, or point of compression allows the fluids to return to its fluid or liquid state post the impact, and will act or behave the same with each repeated impact. The present invention designed to protect the head from injury resulting from sports and other impacts using an added layer with the STF to prior art padded liner systems to dissipate and energy attenuate the impact force resulting from contact just past the point of compression in a non-Newtonian Football & Other Sport Helmetry Liner System.

The method embodies a non-Newtonian football and other sport helmet liner system that is activated by the impact force on the liner system and the non-Newtonian fluid contained within the layer of the liner system nearest or closest to the helmet shell resulting in dissipation and energy attenuation of the impact force.

The present invention relates to a head protective device for protection from impact-based injuries, especially relating to sports activities, is provided by a plastic liner outer material/element/member, with an inner enclosed plastic or flexible polymer system with a cavity to house or contain non-Newtonian fluid contained therein. Non-Newtonian fluid, is strategically provided in a portion of or the entire liner system member(s) within the liner system of the outer layer nearest to, or located closest to the helmet outer shell material/element/member for protecting the human head from injuries related to impact during sports or athletic activities.

The present invention may have inner layer cell(s) attached to, or as part of the outer layer liner cell(s), which may be constructed using sealants or adhesives, heat sealing, cements, glues, fusing techniques, and other materials or techniques not listed, or a combination thereof, or currently in production, and potentially throughout the helmet with the non-Newtonian fluid system contained and sealed therein and contained within the outer cell layer. Suitable flexible yet resilient plastics used for the inner and outer sealed layer(s) system using polyurethanes, polyolefins or any polymeric material polyethylene, and review of use of polypropylene, polystyrene, polyvinyl chloride, and polytetrafluoroethylene that is flexible, but durable for holding shape under impact conditions, excessive heat conditions, not losing its strength or shape with impact force. The non-Newtonian fluid can be comprised of a simple dilitant or non-Newtonian fluids that exhibit viscoelatic properties, so long as the capacity of materials exhibit both viscous and elastic characteristics when undergoing deformation under the resultant of pound force of compressive pressure from impact force to the human head. The liner system outer layer that contains non-Newtonian fluid may be joined to one another in various different methods, such as mechanical connectors, adhesives, cements, glues, fusing techniques, and other materials or techniques not listed.

The following description includes various examples of the invention, which are referenced and reference is made to the associated drawings, which form a part hereof, and in which are shown by way of illustration example systems. Also, the following description includes various examples of the invention, which are referenced and reference is made to the associated drawings, which form a part hereof, and in which are shown by way of illustration example environments and usage the invention may be employed. It is to be stated that other configurations, usages, aspects of use, parts, portions, example systems may be used and structural and functional modifications or alterations may be made without taking leave from the scope of the present invention. Terms, such as "around," "through," "top," "bottom," "side," "above," "below," "underneath," "over," "clear," "transparent," "inner," "outer," "fluids," "soft," "single," "double," "viscosity," "dissipate," "energy attenuate," "force," "impact," linear," "rotational," "angular," "acceleration," etc. may be used to describe the invention, and the various examples, and example aspects, facets, features, elements of the invention, these terms are used herein as a matter of descriptors and for practicality and expediency based upon the example orientations as shown in the illustrations. Nothing in this specification should be construed as requiring a specific three-dimensional orientation of structures in order to fall within the scope of this invention.

The method embodies a non-Newtonian fluid that is deployed or engaged with resulting impact force on the helmet including, but not limited to a liner system using the dilitant capabilities of a non-Newtonian fluid of the impact force incurred near the point of compression using the protective capability of the non-Newtonian fluid. The non-Newtonian fluid acts as fluid dilitant that is lightweight, but has the properties to immediately convert to a solid or semi-solid substance at the point of impact resulting from the impact force. The dilitant fluid relaxes once the pressure is released with the transfer of the impact energy force.

A general description of the non-Newtonian helmet liner system is now described. Some aspects of the present invention relate generally to helmet systems, to non-Newtonian properties, to protective equipment for safety in sports, and other uses. The figures herein illustrate exemplary embodiments of the liner system invention contained within a helmet shell. The non-Newtonian fluid may occupy one or more placements within the liner portion of the non-Newtonian helmet liner system. The outer layer of the liner system containing the non-Newtonian fluid, or closed/sealed tube made of polyurethanes, polyolefins or any polymeric material may occupy more than one placements within the padded liner systems.

Aspects of the invention relate to safety systems in sports and relates to the non-Newtonian helmet liner system, can be any device that a user places on or over some portion of the human body. The non-Newtonian helmet liner system receiving device, (i.e., a non-Newtonian liner system designed to protect the users head area), which is a non-Newtonian helmet liner system and apparatus including a liner system with an outer layer and an inner layer, the outer layer(s) including at least a liner system member, at least one member of the liner system member including a dilitant, shear thickening fluid, or non-Newtonian fluid.

At least one layer and preferably the outer layer of the liner system or member portion of the non-Newtonian helmet liner system contains the non-Newtonian fluid suspended in the outer layer of the liner system nearest to the helmet shell.

The non-Newtonian fluid of an example embodiment of the invention may occupy a significant portion of the entire outer layer of the liner system or a significant portion of the surface area of the helmet/shell. For example, the non-Newtonian fluid can be spread out anywhere between 1% and 100% of the outer surface area of the helmet. The non-Newtonian helmet liner system may extend laterally and vertically, may have depth, and may have height.

The outer layer of the closed/sealed liner system cell/pocket system may be formed of a variety of materials and/or include a variety of features or element to alter or adjust characteristics of the receiving device. For example, the pliable and durable bladder and/or inner and outer layer(s) of the liner system closed/sealed liner cell or pocket may be formed out of some polymer, such as flexible plastic, including, but not limited to thermoplastics including polyurethanes, polyolefins or any polymeric material, not excluding polyethylene, polypropylene, polystyrene, polyvinyl chloride, and polytetrafluoroethylene.

For example; the non-Newtonian fluid may be contained within the outer closed/sealed liner cell/pocket where each of the noted component part/fluid above will be inserted. To insert the non-Newtonian fluid into the liner system, may be placed within the outer layer, followed by adding the non-Newtonian fluid then sealing the outer layer of the liner system. The non-Newtonian fluid may not present the user or a wearer with an abnormal feeling of fit, comfort, or the like.

Specific examples of the invention and the structures according to the examples of the invention are described in greater detail below. The reader of the invention should be aware that these specific examples and structures are set forth simply to illustrate the invention, and they should not be construed as limiting the invention.

Referring now to the drawings, wherein the showings are for purposes of illustrating the present invention and not for purposes of limiting the same, FIGS. 1-9 show embodiments of a helmet, helmet system or helmet assembly that includes a non-Newtonian fluid liner therein in accordance with preferred embodiments of the present invention.

Figure 2:
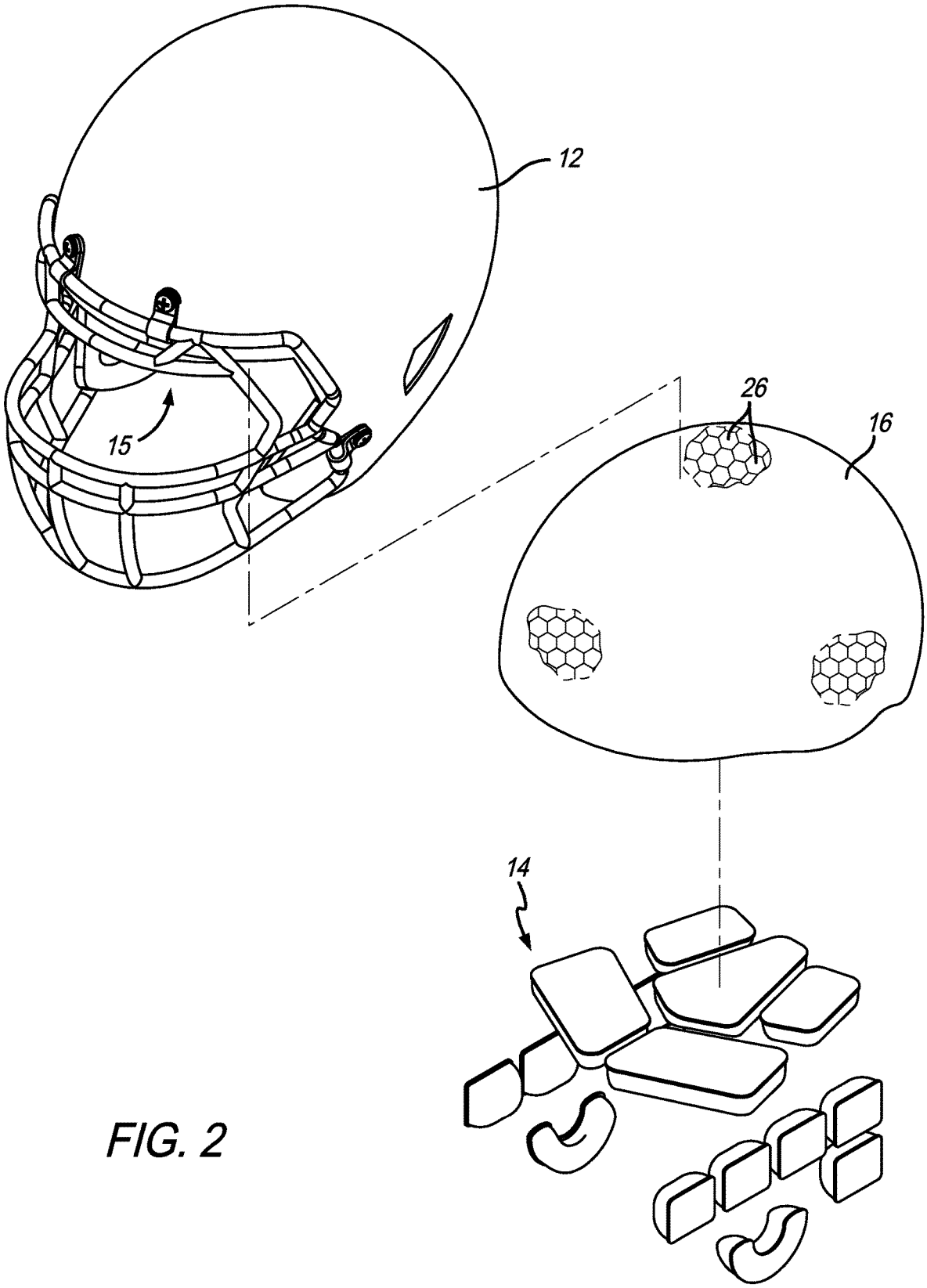
FIG. 2 is an exploded view of the helmet assembly of FIG. 1 showing the outer shell, bladder member and pad system.
Figure 3:
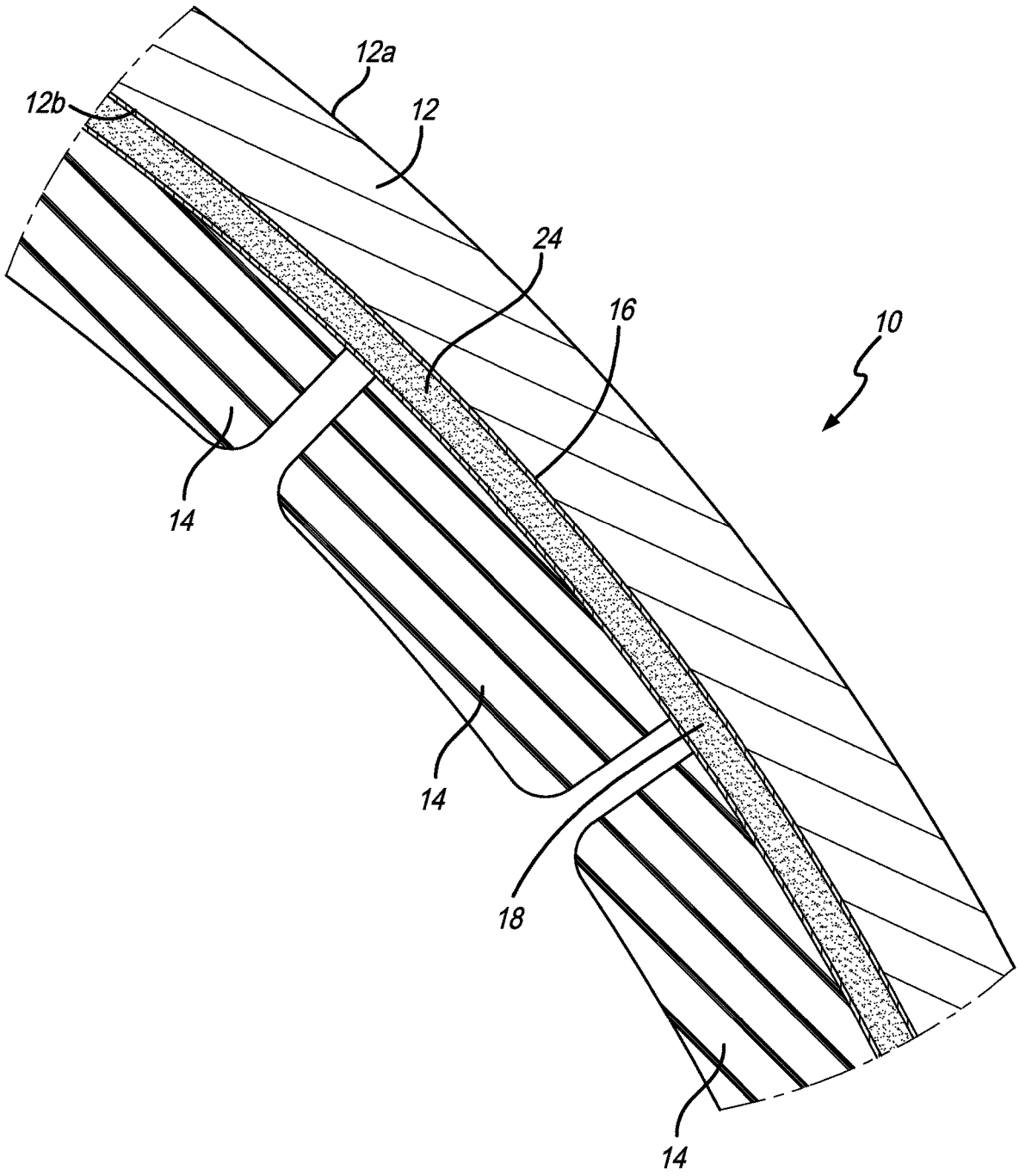
FIG. 3 is a cross-section of a portion of the helmet assembly of FIG. 1 in accordance with an embodiment of the invention.
Figure 4:
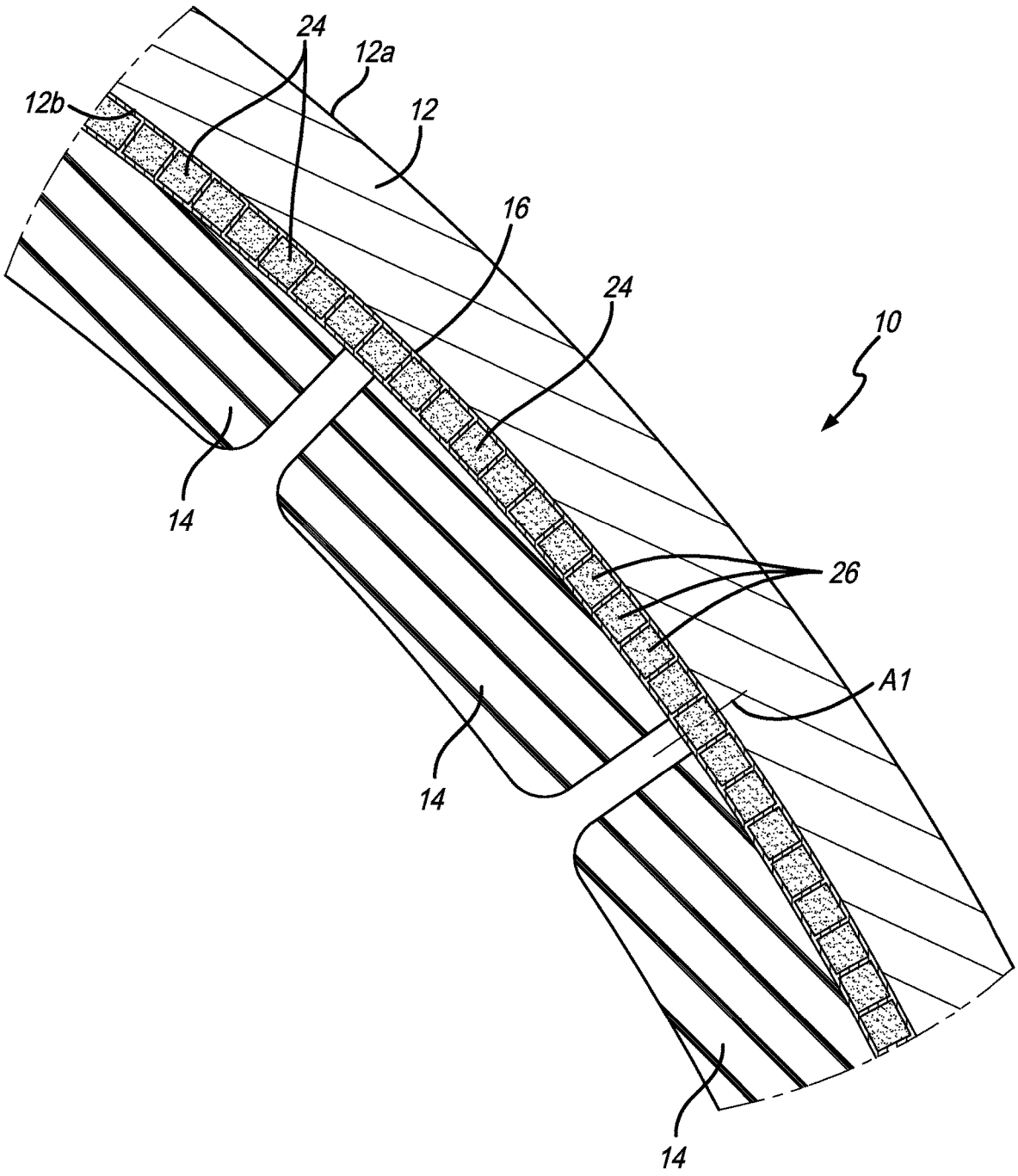
FIG. 4 is a cross-section of a portion of the helmet assembly of FIG. 1 in accordance with another embodiment of the invention.

As shown in FIGS. 1-3, the helmet assembly 10 includes an outer shell 12, a pad system 14 or padding disposed in the shell interior 15, and at least a first bladder member 16. The outer shell 12 includes an outer surface 12*a* and an inner surface 12*b*. The helmet assembly 10 can be any helmet for any use. In the drawings, the helmet assembly 10 is a football helmet that includes a facemask 11, ear holes 13 and other components known in football helmets. As shown in FIGS. 3 and 4, in a preferred embodiment, the bladder member 16 is positioned between the inner surface 12*b* of the outer shell 12 and the pad system 14. The bladder member (s) 16 can be secured to the inner surface 12*b* of the outer shell 12 in a number of different ways or methods. For example, the bladder member can be secured to the outer shell using adhesive, Velcro, snaps, clips, etc. The securing of the bladder member can be permanent or temporary. Temporary securing of the bladder member 16 (e.g., Velcro or other hook and loop fasteners) can allow a user to reposition the bladder member(s) as desired. Furthermore, the pads 14 can be secured to the bladder member(s) 16 using any method as described herein. It will be appreciated that there may be layers between the outer shell and the bladder member 16 or between the bladder member 16 and the pads. Therefore, "secured to" does not mean that it has to be directly secured thereto.

The bladder member 16 defines a bladder interior 18, and a non-Newtonian fluid 24 is disposed in the bladder interior 18. The bladder member 16 can be completely open on the inside thereof and have the non-Newtonian fluid 24 distributed throughout, as shown in FIG. 3. In another embodiment, the bladder member 16 can include a plurality of cells or pockets therein. As shown in FIGS. 2 and 4, in a preferred embodiment, the bladder member 16 includes a plurality of honeycomb cells 26 and each cell includes the non-Newtonian fluid 24 disposed therein. In a preferred embodiment, each cell 26 defines a cell axis A1 that extends generally perpendicular to the outer surface of the wearer's skin. In other words, the cell axes are oriented generally perpendicular to the inner and outer surfaces of the outer shell 12. In another embodiment, the cells can be oriented so that the cell axes are not perpendicular to the inner and outer surfaces of the outer shell 12. In another embodiment, there can be multiple layers of cells.

Figure 5:
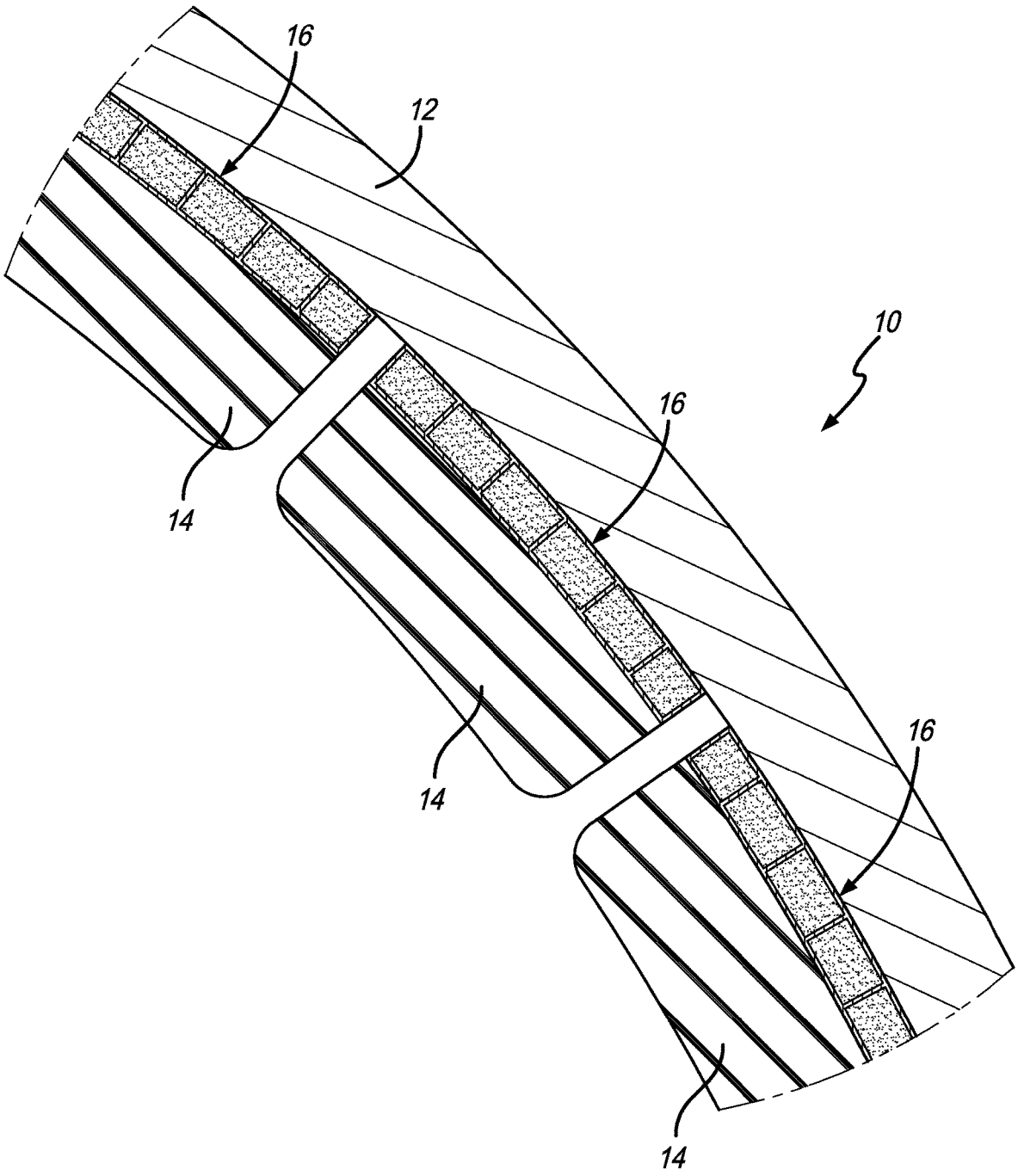
FIG. 5 is a cross-section of a portion of the helmet assembly of FIG. 1 in accordance with another embodiment of the invention that includes a plurality of bladder members.

As shown in FIGS. 3 and 4, the bladder member 16 is secured, adhered or otherwise affixed to or adjacent to the inner surface of the outer shell 12 and the pad system or pads 14 are secured, adhered or otherwise affixed to or adjacent to the inner layer of the bladder member 16. In another embodiment, there can be a plurality of bladder members 16 secured, adhered or otherwise affixed to or adjacent to the inner surface of the outer shell 12. In a preferred embodiment, the non-Newtonian fluid comprises corn starch and non-toxic antifreeze. However, any non-Newtonian fluid is within the scope of the present invention. FIG. 5 shows an embodiment of the invention where a separate bladder member 16 is positioned between the outer shell 12 and each pad 14.

Figure 6:
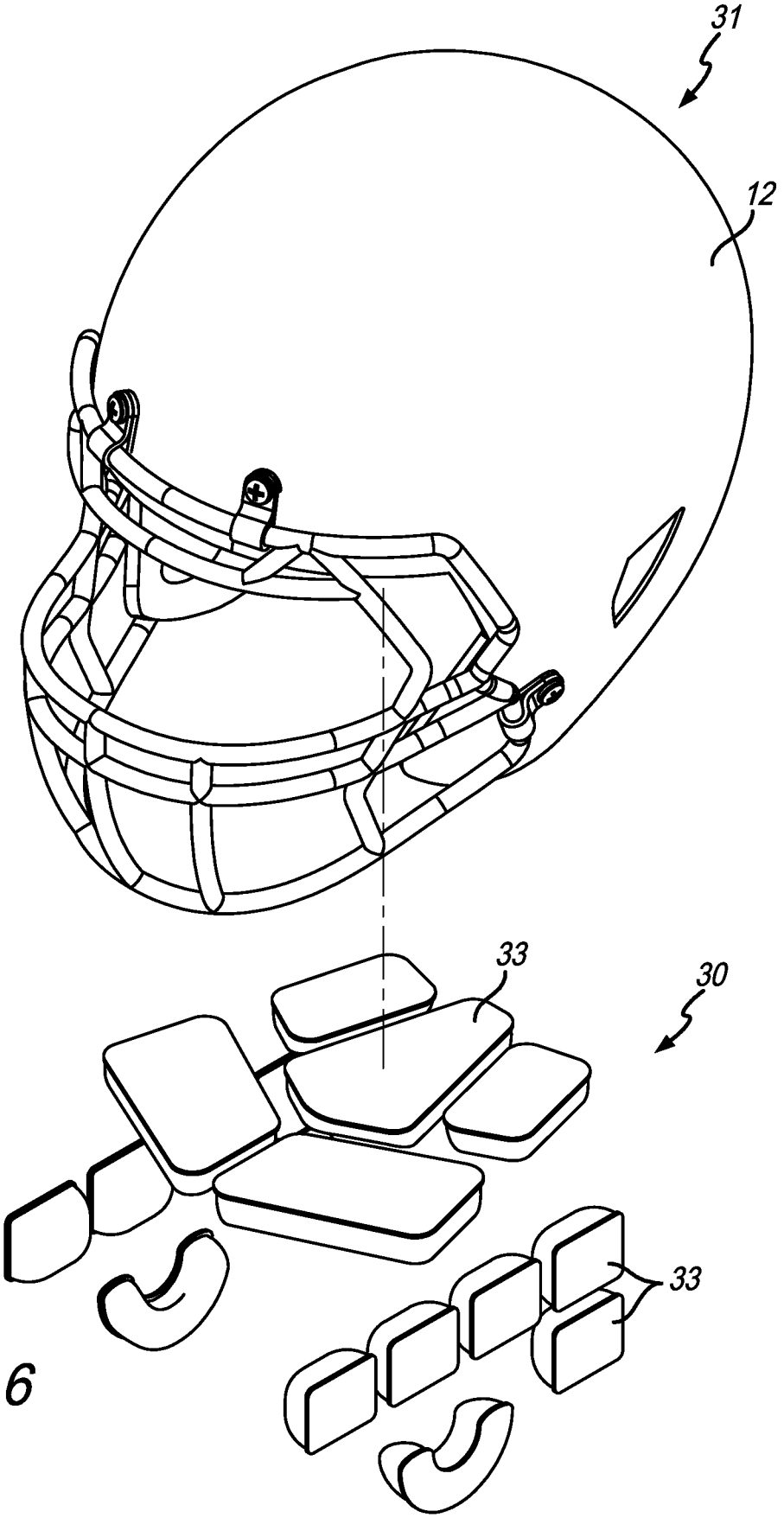
FIG. 6 is an exploded view of a helmet assembly in accordance with another embodiment of the present invention showing the outer shell and pad system.
Figure 7:
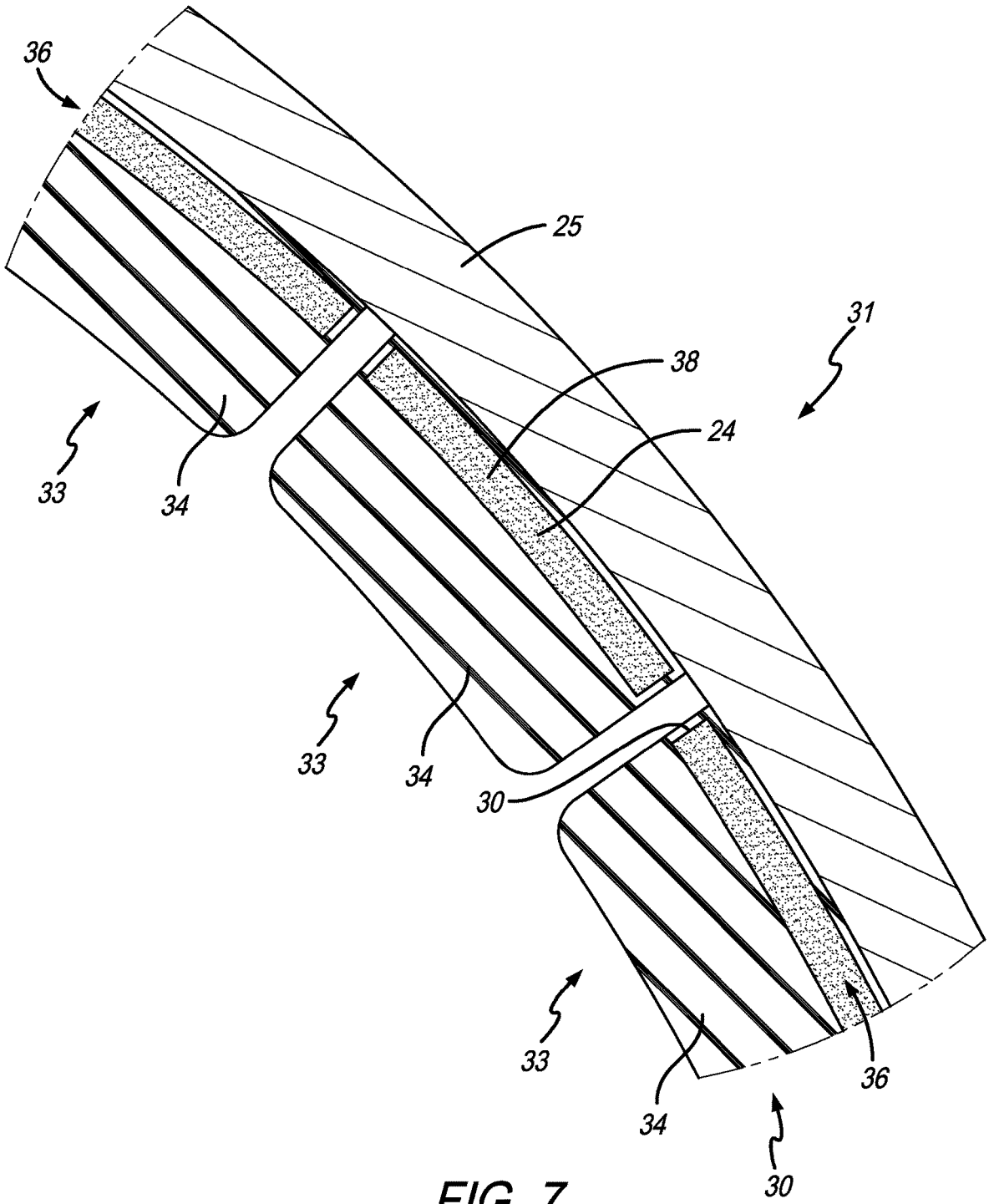
FIG. 7 is a cross-section of the helmet assembly of FIG. 6 showing pad members that include a pocket having a non-Newtonian fluid therein.
Figure 8:
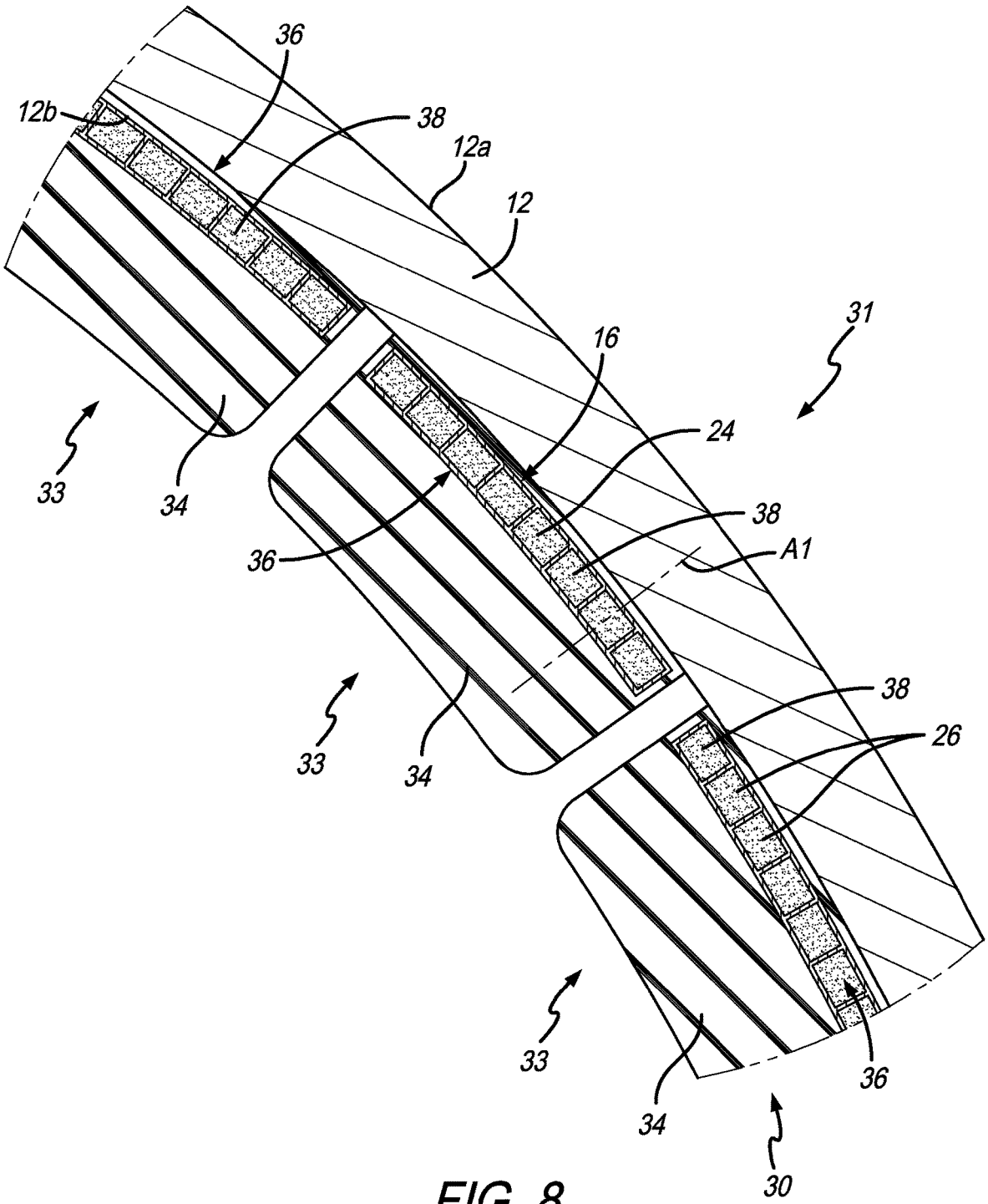
FIG. 8 is a cross-section of the helmet assembly of FIG. 6 showing pad members that include a pocket with cells having a non-Newtonian fluid therein.

FIGS. 6-8 show another embodiment of a helmet assembly 31 that includes an outer shell 12 and a pad system 30 that includes the non-Newtonian fluid in individual pad member or assembly 33. The pad system 30 is disposed in the shell interior 15. As shown in FIG. 7, in a preferred embodiment, one or more of the pad assemblies 33 include a pad portion 34 and a fluid portion 36. The pad portion 34 is made of pad material, as is typically found in helmets, and the fluid portion 36 includes the non-Newtonian fluid. Preferably, the fluid portion 36 is positioned between the pad portion 34 and the outer shell 12. Preferably, the fluid portion 36 defines a pocket 38 that includes the non-Newtonian fluid 24 disposed therein.

The pocket 38 can be completely open and include the non-Newtonian fluid 24 disposed therein, as shown in FIG. 7 or, as shown in FIG. 8, the pocket 38 can include a plurality of cells 26 defined therein, where each cell includes the non-Newtonian fluid 24 disposed therein. It will be appreciated that some of the pads in the pad system may include pockets with non-Newtonian fluid therein and other pads may not. The pad assemblies 33 can be secured to the inner surface 12*b* of the outer shell 12 in a number of different ways or methods. For example, the pad assemblies can be secured to the outer shell using adhesive, Velcro, snaps, clips, etc. The securing of the pad assemblies can be permanent or temporary. Temporary securing of the pad assemblies 33 (e.g., Velcro or other hook and loop fasteners) can allow a user to reposition the pad assemblies as desired.

Figure 9:
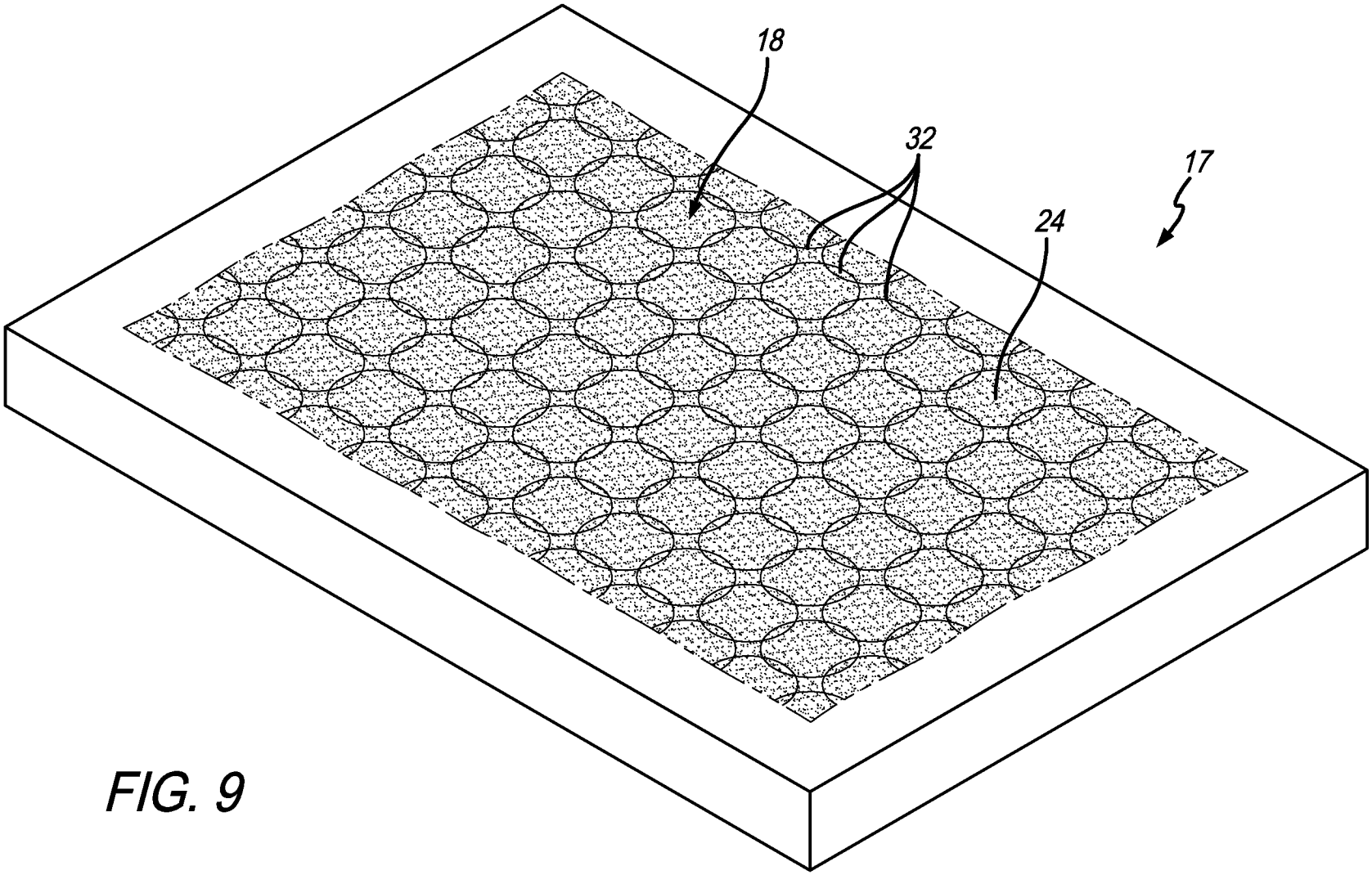
FIG. 9 is a perspective view of a bladder with a set of coils therein, in accordance with a preferred embodiment of the present invention.

FIG. 9 shows a bladder member 17 with a coil system or plurality of coils 32 disposed in the bladder interior 18 and immersed in the non-Newtonian fluid 24. The coils 32 have the characteristics described in the '060 patent, discussed above. The coil system can be used in any of the embodiments discussed herein.

There may be many modifications to the specifically described structures, systems, and methods of the invention may take place without departing from this invention. As an example, while the invention has been specifically described with respect to specific examples including preferred modes of carrying out the invention, those skilled in the art will appreciate that there may be numerous variations, combinations, and permutations of the above described systems and methods. Furthermore, various specific structural features included in the examples merely represent examples of structural feathers that may be included in some examples of structure according to the invention. Furthermore, with respect to the methods, many variations in the method steps may take place, the steps may be changed in order, various steps or features may be added changes, or omitted, etc., without departing from the invention. Thus, the reader should understand that the spirit and scope of the invention should be construed broadly as set forth in the appended claims.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and applications and other references are articles noted herein, including any that may be listed in accompanying filing papers, charts or figures are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A helmet assembly comprising:

an outer shell that includes an outer surface and an inner surface and defines a shell interior, a pad system disposed in the shell interior, wherein the pad system includes at least first and second pad members, wherein the first pad member includes a first pocket that includes a non-Newtonian fluid disposed therein, wherein the second pad member includes a second pocket that includes a non-Newtonian fluid disposed therein, and a first set of coil members that are disposed in the first pocket, wherein the first set of coil members are immersed within the non-Newtonian fluid in the first pocket, a second set of coil members that are disposed in the second pocket, wherein the second set of coil members are immersed within the non-Newtonian fluid in the second pocket.

2. The helmet assembly of claim 1 wherein the first pocket includes a plurality of cells defined therein, wherein each cell includes the non-Newtonian fluid disposed therein, wherein the second pocket includes a plurality of cells defined therein, and wherein each cell includes the non-Newtonian fluid disposed therein.

3. The helmet assembly of claim 2 wherein each cell has a honeycomb shape.

4. The helmet assembly of claim 3 wherein each cell defines a cell axis, and wherein the cell axes are oriented generally perpendicular to the inner surface of the inner surface of the helmet.

5. The helmet assembly of claim 1 wherein the first pocket comprises a first bladder member that comprises a polymer, and wherein the second pocket comprises a second bladder member that comprises a polymer.

6. The helmet assembly of claim 1 wherein the non-Newtonian fluid comprises corn starch and non-toxic anti-freeze.

7. The helmet assembly of claim 1 wherein the first and second pad members are temporarily secured to the outer shell.

8. The helmet assembly of claim 7 wherein the first and second pad members are secured to the outer shell using hook and loop fasteners.

* * * * *